US007034650B2

(12) United States Patent
Yu

(10) Patent No.: US 7,034,650 B2
(45) Date of Patent: Apr. 25, 2006

(54) PROTECTION MECHANISM FOR SWITCHES

(76) Inventor: Tsung-Mou Yu, No. 4, Alley 2, Lane 23, Sec. 3, Pa Te Rd., Panchiao City, Taipei Hsien (TW)

( * ) Notice: Subject to any disclaimer, the term of this patent is extended or adjusted under 35 U.S.C. 154(b) by 0 days.

(21) Appl. No.: 10/889,243

(22) Filed: Jul. 10, 2004

(65) Prior Publication Data

US 2006/0006980 A1 Jan. 12, 2006

(51) Int. Cl.
*H01H 71/16* (2006.01)

(52) U.S. Cl. ..... 337/59

(58) Field of Classification Search ..... 337/37, 337/59, 66, 67, 70, 72, 74, 75, 126; 29/622; 200/339, 401, 553
See application file for complete search history.

(56) References Cited

U.S. PATENT DOCUMENTS 4,167,720 A 9/1979 Krasser ..... 337/60
4,937,548 A 6/1990 Sdunek ..... 337/70
5,223,813 A 6/1993 Cambreleng et al. ..... 337/66
5,262,748 A 11/1993 Tsung Mou ..... 337/66
5,451,729 A 9/1995 Onderka et al. ..... 200/18
5,558,211 A 9/1996 Heydner et al. ..... 200/553
5,933,069 A * 8/1999 Huang ..... 337/66
6,822,179 B1 * 11/2004 Huang ..... 200/401

* cited by examiner

*Primary Examiner*—Anatoly Vortman
*Assistant Examiner*—Corey Broussard

(57) ABSTRACT

A protection mechanism for a switch device includes a pivotably member pivotably connected to an underside of the switch member pivotably connected to an open top of the case of the switch device. The pivotable member includes a shorter tongue and two rods. An end of the bimetallic plate is inserted between the two rods and the tongue so that when the switch member is pressed on one end, the bimetallic plate is lifted to set the switch device to "OFF" position. When the switch member is pressed on the other end, the pivotable member is lowered and the tongue pushes the bimetallic plate to "ON" position. The pivotable member is pivoted an angle and moved toward a space in the case so that the tongue is shifted a distance such that the bimetallic plate is not stopped by the tongue when it is deformed due to overload.

7 Claims, 4 Drawing Sheets

(OFF)

(ON)

PROTECTION MECHANISM FOR SWITCHES

FIELD OF THE INVENTION

The present invention relates to a protection mechanism for a switch device wherein the bimetallic plate can be deformed completely when the switch device is overloaded.

BACKGROUND OF THE INVENTION

The conventional circuit breaker uses a fuse between the switch and the circuit such that when there is an electrical overload, the fuse will first melt before the overload causes damages. However, if the fuse is not properly installed or an improper fuse is used the overload current cannot melt the fuse and a disaster can be caused. U.S. Pat. Nos. 5,262,748, 4,167,720, 4,937,548, 5,223,813, 5,451,729, and 5,558,211 disclose different types of circuit breakers which commonly include a complicated mechanism to drive the bimetallic plate which is expected to be deformed and bent when there is overload in current. Nevertheless, it is noted that the bimetallic plate may not be completely deformed as desired because it is not possible to be freely deformed when the overload current occurs, and the bimetallic plate is still in contact with the terminal to generate sparks and therefore cause disaster.

Therefore, it is desired to have a protection mechanism for a switch device that includes a pivotable member with a shorter tongue and the pivotable member is pivoted an angle when the switch device is in "ON" position and the bimetallic plate is deformed upward and not stopped by the shorter tongue.

SUMMARY OF THE INVENTION

In accordance with an aspect of the present invention, there is provided a switch device that comprises a case having a switch member pivotably engaged with an open top of the case and a connection member is connected to the switch member. A first terminal and a second terminal respectively extend through a bottom of the case. A bimetallic plate has a first end fixed to the first terminal and a first contact point is connected to a second end of the bimetallic plate. A second contact point is connected to the second terminal and located beneath the first contact point. A protection mechanism includes a pivotable member pivotably connected to the connection member of the switch member and two rods extend from a first side of the pivotable member. A tongue is pivotably connected to the pivotable member and located above the two rods. The second end of the bimetallic plate is located between the two rods and the tongue so that the second end of the bimetallic plate can be lifted to set the switch device to "OFF" position when the switch member is pressed on an "OFF" side. The second end of the bimetallic plate is pushed downward by the tongue to set the switch device to "ON" position when the switch member is pressed on an "ON" side. The tongue pushes the second end of the bimetallic plate down and the pivotable member is pivoted an angle to move the tongue away from the second end of the bimetallic plate after the switch member is switched from the "OFF" position to the "ON" position. The second end of the bimetallic plate can be deformed upward and not stopped by the tongue when the switch is overloaded.

The present invention will become more obvious from the following description when taken in connection with the accompanying drawings, which show, for purposes of illustration only, a preferred embodiment in accordance with the present invention.

DETAILED DESCRIPTION OF THE PREFERRED EMBODIMENT

Figure 1:
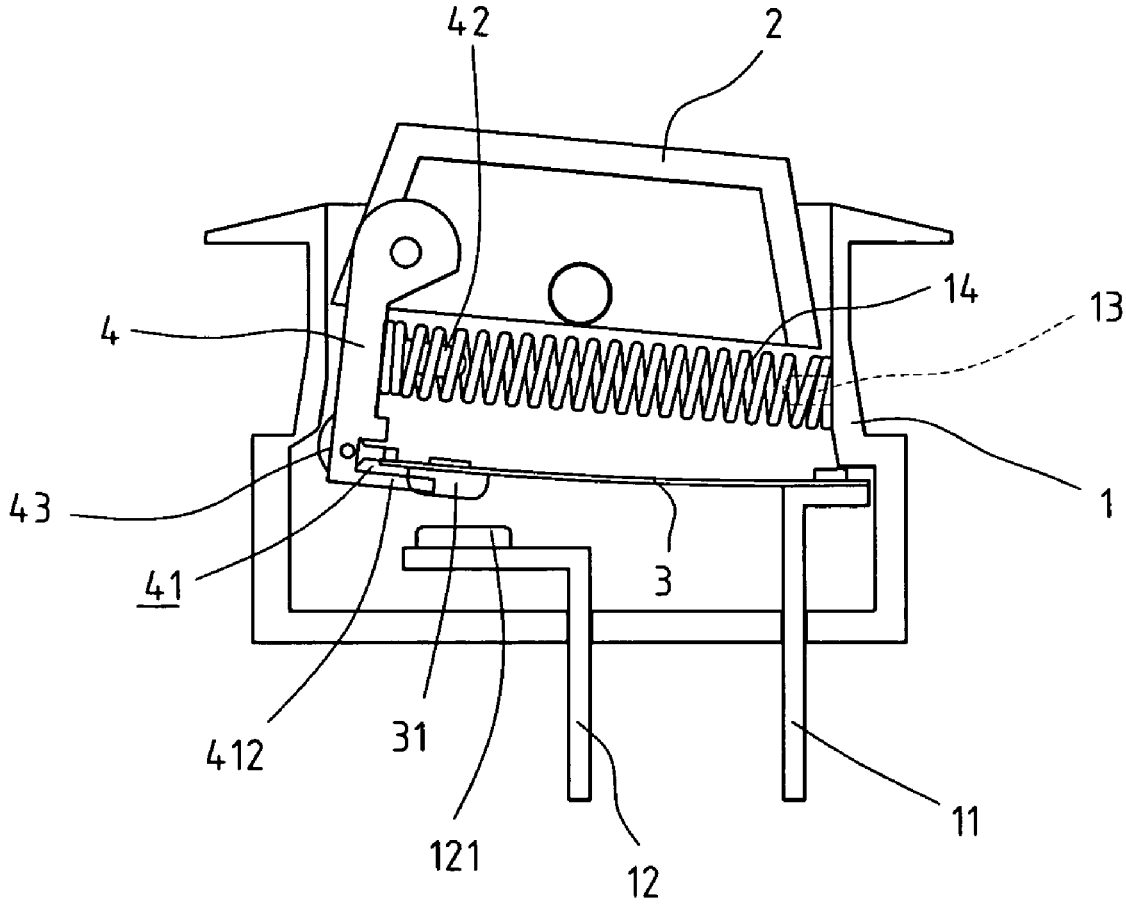
FIG. 1 shows the "OFF" status of a switch device of the present invention.

Referring to FIGS. 1–4, a switch device of the present invention comprises a case 1 having an open top and a switch member 2 is pivotably engaged with the open top of the case. A connection member is connected to an underside of the switch member 2 and the connection member has a rod 21 in this embodiment. The case 1 includes a first protrusion 13 extending from an inside thereof A first terminal 11 and a second terminal 12 respectively extend through a bottom of the case 1. A bimetallic plate 3 has a first end fixed to the first terminal 11 and a first contact point 31 is connected to a second end of the bimetallic plate 3. A second contact point 121 is connected to the second terminal 12 and located beneath the first contact point 31.

A protection mechanism includes a pivotable member 4, which includes a connection portion 40 and a passage 401 is defined through the connection portion 40 at an end of the pivotable member 4. The pivotable member 4 is pivotably connected to the connection member of the switch member 2 by inserting the rod 21 of the connection member in the passage 401. Two rods 412 extend from a first side of the pivotable member 4 and a tongue 411 is pivotably connected to the pivotable member 4 and located above the two rods 412. The tongue 411 is shorter than the two rods 412. The tongue 411 includes a through hole 4110 in one end thereof and a pin 4111 extends through the pivotable member 4 and the through hole 4110, so that the tongue 411 is pivotable in a space defined between the two rods 412. The second end of the bimetallic plate 3 is located in the space 41 between the two rods 412 and the tongue 411. The pivotable member 4 includes a flange 400 extending form the first side thereof and the tongue 411 is located below the flange 400 so that the flange 400 prevents the tongue 411 from being pivoted upward.

Figure 2:
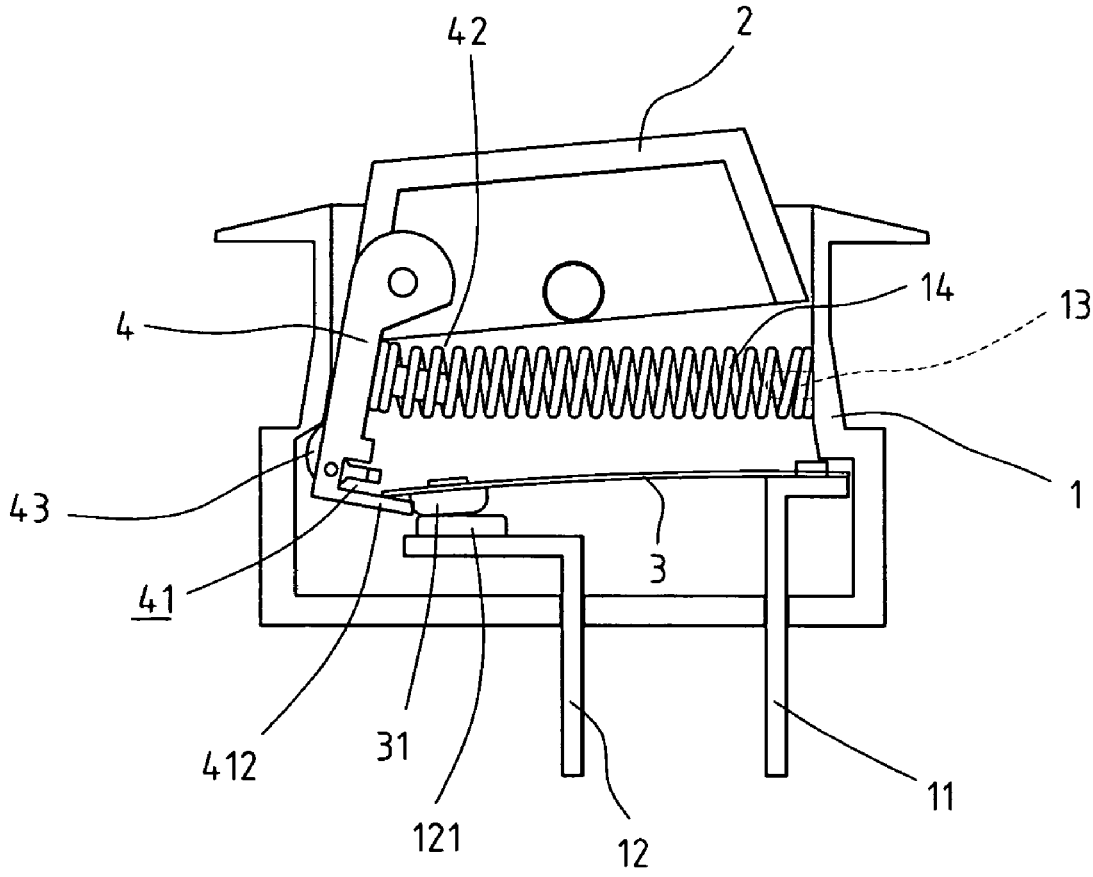
FIG. 2 shows the "ON" status of the switch device of the present invention.

A first protrusion 13 extends from an inside of the case 1 and the pivotable member 4 includes a second protrusion 42 extending from the first side thereof. A spring 14 has its two ends mounted to the first and second protrusions 13, 4 respectively. A convex portion 43 extends from a second side of the pivotable member 4 and the convex portion 43 is forced to be in contact with an inside of the case 1 by the spring 14. As shown in FIG. 1, the second end of the bimetallic place 3 is lifted by the two rods 412 to set the switch device to "OFF" position when the right end of the switch member 2 is pressed. As disclosed in FIG. 2 when pressing the left end of the switch member 2, the pivotable member 4 is rotated an angle and the tongue 411 pushes the second end of the bimetallic plate 3 downward to set the switch device to "ON" position. The pivotable member 4 is pivoted to move the convex portion 43 in a recess in the case 1 when the switch device is in "ON" position, the tongue 411 is moved with the pivotable member 4 toward left as shown in FIG. 2.

Figure 3:
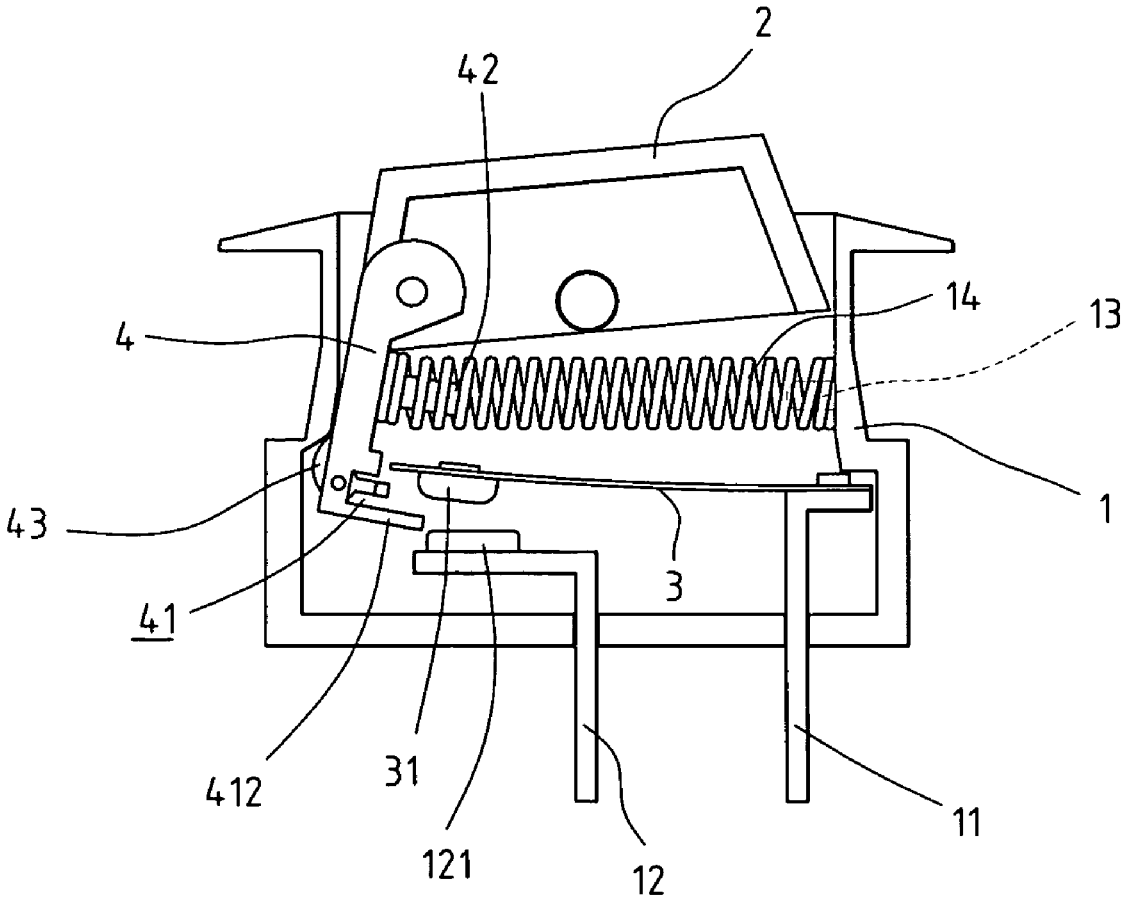
FIG. 3 shows that a bimetallic plate is deformed due to overload and a second end of the bimetallic plate is not stopped by the tongue.
Figure 4:
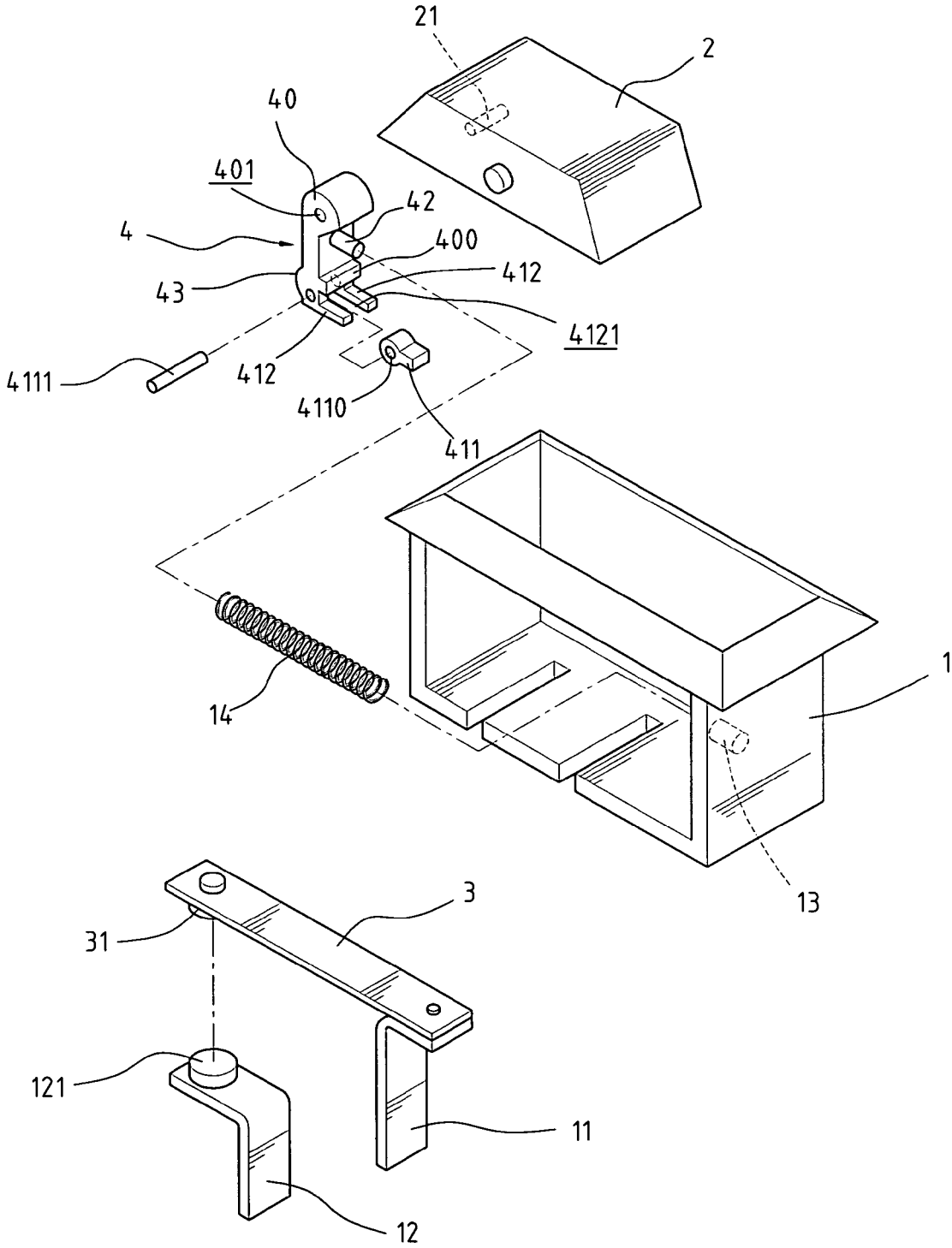
FIG. 4 is an exploded view to show the switch device of the present invention.

When the switch device is overloaded, as shown in FIG. 3, the second end of the metallic plate 3 is deformed upward and not stopped by the tongue 411 which is shifted to left.

While we have shown and described the embodiment in accordance with the present invention, it should be clear to those skilled in the art that further embodiments may be made without departing from the scope of the present invention.

What is claimed is:

1. A switch device comprising:

a case having an open top and a switch member pivotably engaged with the open top of the case, a connection member connected to the switch member;

a first terminal and a second terminal respectively extending through a bottom of the case, a bimetallic plate having a first end fixed to the first terminal and a first contact point connected to a second end of the bimetallic plate, a second contact point connected to the second terminal and located beneath the first contact point, and a protection mechanism including a pivotable member which is pivotably connected to the connection member of the switch member, two rods extending from a first side of the pivotable member and a tongue pivotably connected to the pivotable member and located above the two rods, the second end of the bimetallic plate located between the tongue and the two rods;

wherein the second end of the bimetallic plate is lifted by the two rods to set the switch device to "OFF" position when the switch member is pressed on an "OFF" side, the second end of the bimetallic plate is pushed downward by the tongue to set the switch device to "ON" position and the pivotable member is pivoted an angle to move the tongue away from the second end of the bimetallic plate when the switch member is pressed on an "ON" side, and the second end of the bimetallic plate can be deformed upward without being stopped by the tongue when the switch device is in "ON" position and overloaded.

2. The device as claimed in claim 1, wherein the tongue is shorter than the two rods.

3. The device as claimed in claim 1, wherein the connection member has a rod and the pivotable member has a passage defined in an end thereof, the pivotable member pivotably connected to the switch member by inserting the rod of the connection member in the passage.

4. The device as claimed in claim 1, wherein the case includes a first protrusion extending from an inside thereof and the pivotable member includes a second protrusion extending from the first side of the pivotable member thereof, a spring having two ends which are mounted to the first and second protrusions respectively, a convex portion extending from a second side of the pivotable member and the convex portion being forced in contact with an inside of the case by the spring.

5. The device as claimed in claim 4, wherein the pivotable member is pivoted to move the convex portion in a recess in the case when the switch device is in "ON" position, the tongue moved with the pivotable member so that the second end of the metallic plate is not stopped by the tongue.

6. The device as claimed in claim 1, wherein the tongue includes a through hole in one end thereof and a pin extends through the pivotable member and the through hole, the tongue being pivotable in a space defined between the two rods.

7. The device as claimed in claim 1, wherein the pivotable member includes a flange extending from the first side thereof and the tongue is located below the flange so that the flange prevents the tongue from being pivoted upward.

* * * * *